US005701560A

United States Patent [19]

Tsujita et al.

[11] Patent Number: 5,701,560

[45] Date of Patent: Dec. 23, 1997

[54] IMAGE FORMING APPARATUS HAVING A PHOTOSENSITIVE BODY FORMED OF A BASE MATERIAL CONSISTING OF $AS_2SE_3$ OR A-SI AND A METHOD

[75] Inventors: Akio Tsujita, Hitachinaka; Masayasu Anzai, Hitachi; Tsuneaki Kawanishi, Toukai-mura, all of Japan

[73] Assignee: Hitachi Koki Co., Ltd., Tokyo, Japan

[21] Appl. No.: 675,545

[22] Filed: Jul. 3, 1996

[30] Foreign Application Priority Data

| | | | |
|---|---|---|---|
| Jul. 14, 1995 | [JP] | Japan | 7-179082 |
| Nov. 24, 1995 | [JP] | Japan | 7-306097 |
| Apr. 4, 1996 | [JP] | Japan | 8-082775 |

[51] Int. Cl.[6] ..... G03G 15/00

[52] U.S. Cl. ..... 399/159; 347/139; 347/264; 399/56; 399/128; 430/66; 430/125

[58] Field of Search ..... 355/210, 211, 355/219, 221, 228, 229, 245, 246, 271; 430/46, 125, 84, 31, 66, 95; 399/159, 43, 128, 56, 343; 347/129, 139, 225, 262, 264

[56] References Cited

U.S. PATENT DOCUMENTS

| | | | |
|---|---|---|---|
| 3,575,505 | 4/1971 | Parmigiani | 355/246 |
| 4,134,763 | 1/1979 | Fujimura et al. | 430/66 X |
| 4,623,243 | 11/1986 | Iijima et al. | 355/219 |
| 4,748,934 | 6/1988 | Mochizuki et al. | 355/246 X |
| 4,841,328 | 6/1989 | Takeuchi et al. | 355/211 |
| 4,892,800 | 1/1990 | Sugata et al. | 430/95 X |
| 4,897,333 | 1/1990 | Matsushita | 430/125 X |
| 5,028,502 | 7/1991 | Yuh et al. | 430/31 |
| 5,112,709 | 5/1992 | Yamazaki et al. | 430/46 |

*Primary Examiner*—Arthur T. Grimley
*Assistant Examiner*—Sophia S. Chen
*Attorney, Agent, or Firm*—Antonelli, Terry, Stout & Kraus, LLP.

[57] ABSTRACT

In an image forming apparatus forming an electrostatic latent image on a surface of a photosensitive body by exposing the charged photosensitive body, developing the latent image using a toner to form a toner image, transferring the toner image to a image holding body, and erasing the remaining charge on the surface of the photosensitive body after completion of the transferring, the photosensitive body is formed of a base material consisting of $As_2Se_3$ or a-Si, and wherein the wavelength $\lambda_0$ of the writing light used for the exposure is limited to a wavelength not larger than 780 nm, the wavelength $\lambda_1$ of charge erasing light used for the charge erasing is limited to a wavelength smaller than 680 nm, and the time $T_1$ from completion of the exposure to initiation of the development is limited within the range of 70 milliseconds to 300 milliseconds.

25 Claims, 8 Drawing Sheets

JUST AFTER DEVELOPING

JUST BEFORE TRANSFERRING

| IODINE ADDING AMOUNT (ppm) | INITIAL VOLTAGE $V_0$ ( V ) | REMAINING VOLTAGE $V_r$ ( V ) | 0.3 SECOND VALUE OF VOLTAGE MAINTAINING RATE ( % ) | LIGHT RESPONSE TIME ( ms ) |
|---|---|---|---|---|
| 0 | 800 | 95 | 88 | 120 |
| 1 | 800 | 90 | 82 | 90 |
| 5 | 800 | 90 | 80 | 88 |
| 10 | 790 | 90 | 75 | 80 |
| 20 | 780 | 88 | 73 | 75 |
| 50 | 750 | 87 | 70 | 72 |
| 100 | 740 | 85 | 63 | 70 |
| 300 | 740 | 85 | 58 | 70 |
| 500 | 730 | 81 | 52 | 69 |
| 700 | 650 | 81 | 42 | 68 |
| 1000 | 620 | 81 | 38 | 68 |

| DEVELOPING BIAS VOLTAGE ( V ) | | | IMAGE DARKNESS ( D ) | FOG LEVEL ( % ) |
|---|---|---|---|---|
| FIRST ROLL | SECOND ROLL | THIRD ROLL | | |
| 400 | 400 | 400 | 1.75 | 0.85 |
| 400 | 350 | 300 | 1.55 | 0.50 |
| 350 | 350 | 400 | 1.65 | 0.70 |
| 350 | 350 | 300 | 1.60 | 0.50 |
| 350 | 300 | 250 | 1.50 | 0.45 |
| 300 | 300 | 300 | 1.45 | 0.65 |
| 300 | 250 | 200 | 1.40 | 0.35 |
| 300 | 350 | 400 | 1.60 | 0.75 |
| 250 | 300 | 350 | 1.55 | 0.70 |

IMAGE FORMING APPARATUS HAVING A PHOTOSENSITIVE BODY FORMED OF A BASE MATERIAL CONSISTING OF $AS_2SE_3$ OR A-SI AND A METHOD

BACKGROUND OF THE INVENTION

The present invention relates to an image forming apparatus utilizing an electro-photographic method, such as a copying machine and a printer, and, more particularly, to an image forming apparatus utilizing reversal development.

Reversal development is one of the well-known developing methods used in an image forming apparatus. Well-known photosensitive materials used for this electro-photographic method are Se, Se-Te, $As_2Se_3$, OPC and a-Si (amorphous silicon).

Since the amount of information to be processed has grown larger in recent years, a printer, particularly, a line-printer, is required to have a higher printing ability and a higher quality and a higher precision in image quality. In addition, higher speed printing is desired. In high speed printing, the abrasion of the photosensitive material becomes a factor, which is largely due to friction with the paper and/or the developing agent. Therefore, $As_2Se_3$, which has a high hardness in a photosensitive film (Vickers hardness Hv≈150) has been frequently used as a photosensitive material for printers. On the other hand, while a-Si has an even higher surface hardness of Hv≈1200, and accordingly has a high abrasion resistivity, a-Si is used only in very limited types of printers, because the manufacturing cost is about ten times or more as high as that of the other photosensitive materials.

However, since films of $As_2Se_3$ and a-Si have a small volume resistivity of $1\times10^{11}\Omega\cdot$cm, the holding ability of the surface charge by these materials is lower than that of Se, Se-Te and OPC. As a result, a disorder occurs in a latent image pattern in developing or transferring portions thereof due to the difficulty of holding a sufficient contrast voltage, and a degradation in image quality, such as a degradation in resolution, is apt to occur.

Especially, in recent years, it has become necessary to use a semiconductor laser or an LED as an exposure light source in order to reduce the size of the exposure light source unit and/or reduce the cost. However, the semiconductor laser and the LED in the present stage of development are small in light output compared to that of a gas laser, and accordingly, current use of the semiconductor laser and the LED as the exposure light source in a printer or the like has been limited to the case where the wavelength of the light is longer than nearly 600 nm. In a case where an exposure light source having such a long light wavelength (red light, generally having a wavelength of nearly 630 nm or longer) is used, since light having such a wavelength (red light) penetrates deeply into the photosensitive body to a significant distance, an after-image phenomenon is apt to occur, and, consequently, it has been necessary to use light having the same wavelength as the charge erasing light in order to eliminate the after-image phenomenon. As a result, the light fatigue exerted on the photosensitive body becomes larger, which further decreases the charge holding force of the photosensitive body.

As a countermeasure for preventing a degradation in resolution, it has been proposed to sufficiently increase the initial contrast voltage at the exposing stage. However, this increases the burden on the charging process to use a $As_2Se_3$ photosensitive body having a small volume resistivity of photosensitive film and a small charging ability at a high speed and to give a high contrast voltage. This also causes a problem with the withstand voltage of the photosensitive body itself (the withstanding voltage of the $As_2Se_3$ is approximately 15 V/μm).

Further, in a case where a low resistivity developing agent is used, there is a problem in that the surface charge on the photosensitive body leaks to the developing agent to cause a disorder in the latent image. Furthermore, since the $As_2Se_3$ photosensitive body or the a-Si body itself, having a high surface hardness, is hardly abraded by friction during the image forming process and a layer is deteriorated due to ozone forming on the surface of the photosensitive body during use, the photosensitive function is degraded. Still further, since the surface of the photosensitive body is roughened by the deteriorated layer described above, the developing agent and a powder of the paper attach onto the surface of the photosensitive body to often cause a filming phenomenon.

As for a countermeasure for preventing the filming phenomenon, it has been found effective to roughen the surface of the photosensitive body in advance and improve the cleaning efficiency of the cleaning member (a cleaning brush or a cleaning blade) by increasing the frictional force with the cleaning member. However, the surface area of the photosensitive body is increased by being roughed, and so the leakage of charge along the surface of the photosensitive body becomes larger and the latent image is further disordered. The charge leakage on the surface of the photosensitive body becomes a problem particularly when an image is formed with a resolution above 600 dpi.

SUMMARY OF THE INVENTION

An object of the present invention is to provide an image forming apparatus which can stably attain a high print quality even when the image forming speed is high.

Another object of the present invention is to provide an image forming apparatus which does not produce fog (background noise) or degradation of resolution and which can stably attain a high print quality even when employing an $As_2Se_3$ photosensitive body or an a-Si photosensitive body with a high printing resistivity and a long life expectancy, and in which the charging condition, the developing condition, the exposure and charge erasing condition and the photosensitive body specification are optimized.

The object of the present invention can be attained by providing an image forming apparatus forming an electrostatic latent image on a surface of a photosensitive body by exposing the charged photosensitive body, developing the latent image using a toner to form a toner image, transferring the toner image to a image holding body, and erasing the charge on the surface of the photosensitive body after completion of the toner image transferring operation, in which the photosensitive body is a photosensitive body formed of a base material consisting of $As_2Se_3$ or a-Si, the wavelength $\lambda_0$ of writing light used for the exposure is limited to a wavelength not larger than 780 nm, the wavelength $\lambda_1$ of the charge erasing light used for the charge erasing is limited to a wavelength smaller than 680 nm, and the time $T_1$ from completion of the exposure to initiation of the development is limited within the range of 70 milliseconds to 300 milliseconds.

In accordance with the present invention, the dark decay characteristic of the photosensitive body voltage and the deviation in the photosensitive body voltage are improved by optimizing the charging time in connection with the charging condition, and a compatibility between the image concentration and the fog level is attained by optimizing the developing time and the developing bias in connection with the developing condition. In order to decrease the light fatigue of the photosensitive body, that is, the after-image phenomenon and the degradation in the dark decay characteristic, the writing light and the charge erasing light conditions are optimized.

DETAILED DESCRIPTION OF THE PREFERRED EMBODIMENTS

Figure 1:
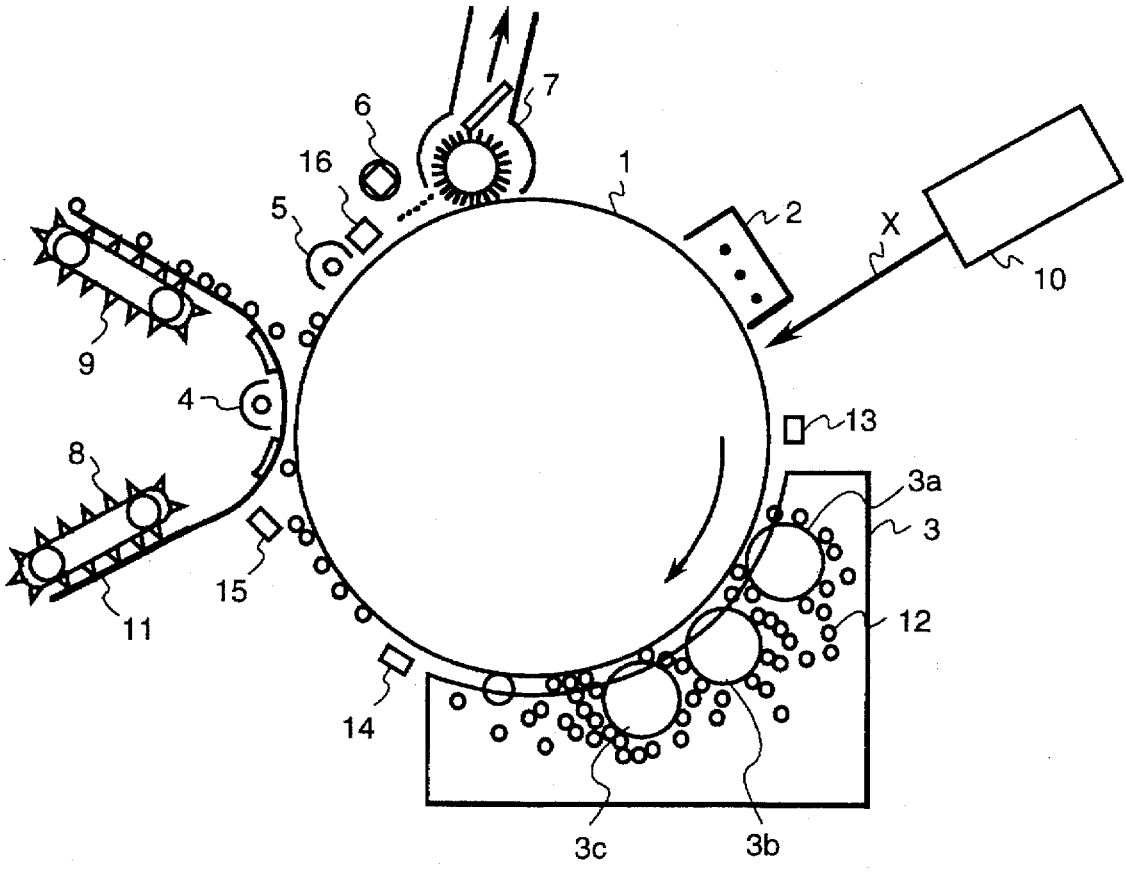
FIG. 1 is a schematic diagram showing the construction of an embodiment of an image forming apparatus in accordance with the present invention.

The present invention can stably attain a high print quality by setting the image forming process conditions, such as the charging, exposure, development, transfer, charge erasing, and cleaning conditions around the photosensitive body, to conditions suitable for an $As_2Se_3$ photosensitive body or an a-Si photosensitive body and by optimizing the characteristics, such as the amount of added impurity, the thickness of the film, and the surface roughness, of the photosensitive body itself, as will be described later.

In detail, stable charging of the $As_2Se_3$ photosensitive body or the a-Si photosensitive body can be realized, any deviation in the charge can be decreased, and a latent image formed in the exposing process can be held without disordering the latent image prior to the transfer process. Further, the charge erasing process for erasing the latent image can completely erase the latent image and any fatigue exerted on the photosensitive body can be deceased as much as possible.

As for the surface roughness of the photosensitive body, it is required that the center line average roughness (Ra) specified by the Japan Industrial Standard be within the range of 0.125 μm to 1.5 μm, more preferably, within the range of 0.2 μm to 0.75 μm. When the surface roughness is smaller than 0.125 μm, the friction force of the cleaning unit is insufficient and the cleaning efficiency cannot be improved; consequently, there is a possibility that filming will be produced. On the other hand, when the surface roughness is larger than 1.5 μm, a deviation of the surface voltage occurs, and a degradation in the image quality, such as an increase in the fog level (background noise), is apt to be caused. This surface roughness condition is effective when the processing speed of the image forming is as high as 500 mm/second to 2000 mm/second.

A corotron or a scorotron is used as the charger, and the width of the charger is set so that the time in which the photosensitive body passes by the charger greater than 50 milliseconds, preferably above 55 milliseconds. Since the charging ability of the $As_2Se_3$ photosensitive body or the a-Si photosensitive body is small, the deviation of the charging becomes large and the dark decay is greatly decreased when the charging time is shorter than 50 milliseconds. As a means for reducing the deviation of the charging in a high speed process, a combination of soft charging using scorotron and corotron charging is effective.

Although it is preferable for the exposing light source (writing light source) for forming an image to produce light of short wavelength, when taking the light fatigue of the photosensitive body and the resolution of the image into consideration, it is required that the wavelength $\lambda_0$ of the writing light be in the range of $\lambda_0 \leqq 780$ nm, preferably, in the range of $\lambda_0 \leqq 680$ nm in view of the recent trend of employing a small sized and low cost LED or LD as the light source and when considering the spectral photosensitivity characteristic and the light wavelength characteristic of the $As_2Se_3$ photosensitive body and the a-Si photosensitive body. In a case where $\lambda_0 > 780$, it is difficult to form a latent image because the photosensitivity of the photosensitive body becomes small, the damage to the photosensitive body becomes large, due to long wavelength light, and the charging ability and the resolution are decreased.

Although it is also preferable for the wavelength $\lambda_1$ of the charge erasing light source to be of short wavelength when taking the light fatigue of the photosensitive body and the resolution of the image into consideration, the light source is a source of red light having a light wavelength above 600 nm (600 nm to 720 nm) because of the recent trend of employing a small sized and low cost LED or LD as the light source. Since light having such a long wavelength (red light) penetrates deeply into the photosensitive body to a substantial distance and an after-image phenomenon is apt to occur, it is preferable for the wavelength $\lambda_1$ to be not larger than 600 nm, and for the quantity of the light to be four times or more as much as that of the writing light. On the other hand, when $\lambda_1 < \lambda_0 - 100$ nm, the effect of the latent image in the preceding process affects the next process and an after-image phenomenon is apt to occur. When $\lambda_1 > 680$ nm, the light fatigue of the photosensitive body by the charge erasing becomes large and the charging ability and the resolution are decreased. The preferable range for $\lambda_1$ is 450 nm to 660 nm. Therefore, the relationship between the wavelength $\lambda_0$ of the writing light and the wavelength $\lambda_1$ is $\lambda_0 - 100 \text{ nm} \leqq \lambda_1 \leqq 680$ nm.

It is required that the time $T_1$ from completion of forming a latent image to initiation of the development satisfies the relationship 70 milliseconds $\leqq T_1 \leqq$ 300 milliseconds, preferably 100 milliseconds$\leqq T_1 \leqq$250 milliseconds. When $T_1$<70 milliseconds, the image forming in the developing portion is not sufficient, that is, a contrast voltage required for developing is not obtained since the light responsive characteristic of the $As_2Se_3$ photosensitive body or the a-Si photosensitive body is low, that is, the mobility of light carriers is nearly one order lower that of a Se-Te photosensitive body. When $T_1$>300 milliseconds, the contrast voltage, that is, the voltage difference on the surface of the photosensitive body between a toner attached portion and a toner non-attached portion is decreased since the charge holding ability of the $As_2Se_3$ photosensitive body or the a-Si photosensitive body is low, that is, the dark decay is large.

It is required that the developing time $T_2$, that is, the contact time between a photosensitive body and a developing brush is within the range of 50 milliseconds$\leqq T_2 \leqq$200 milliseconds, and preferably within the range of 60 milliseconds$\leqq T_2 \leqq$100 milliseconds. When $T_2$<50 milliseconds, it is difficult to obtain a sufficient image density (above 1.4 D) because of the short developing time. On the other hand, when $T_2$>200 milliseconds, a degradation of the image quality, such as fog, is apt to occur, because the friction of the development brush becomes large.

In order to satisfy the required developing condition, that is, the developing time in a high printing speed process, it is preferable to employ a countermeasure, such as a multi-stage developing method or a large diameter developing roll. Further, in the case of a multi-stage developing method, it is preferable for the developing bias voltage applied to the developing roll to be set so as to decrease in the rotating direction toward the downstream side of the photosensitive body. The reason for this is that the contrast voltage on the photosensitive body decreases during developing processing since the surface voltage of the $As_2Se_3$ photosensitive body or the a-Si photosensitive body has a large dark decay characteristic.

For the same reason, in a case of employing the $As_2Se_3$ photosensitive body or the a-Si photosensitive body, it is necessary to pay attention to the contrast voltage in the transfer portion. In this case, it is required that the contrast voltage just before transferring is 300 V or higher, preferably, in the range of 350 V to 500 V. When the contrast voltage just before transferring is lower than 300 V, the force for electrostatically holding the toner attached onto the photosensitive body becomes weak, the toner image is disturbed by the electrostatic attracting force during transferring and by friction with the paper, and accordingly degradation of the image quality, such as degradation of the image resolution, is apt to occur.

It is required that the frequency $\nu$ of AC current applied to the AC corona charger for erasing toner placed downstream of the transfer unit is within the range of 500 Hz$\leqq \nu \leqq$7000 Hz, preferably within the range of 500 Hz$\leqq \nu \leqq$2000 Hz. When $\nu$<500 Hz, the effect on the photosensitive body becomes large and the deviation of the voltage on the non-charged side becomes large. On the other hand, when $\nu$>7000 Hz, the current flowing into the shield of the charger becomes large and consequently the cleaning effect is decreased because the discharging effect of the toner is lowered.

It is necessary for the film thickness of the photosensitive body having the base material of $As_2Se_3$ or a-Si to be above 40 μm and below 80 μm, preferably above 50μ and below 75 μm. When the film thickness of the photosensitive body is thinner than 40 μm, the initial surface voltage of the photosensitive body is hardly obtained and problems, such as dielectric breakdown of the photosensitive body are apt to occur, since the withstand voltage of $As_2Se_3$ is approximately 15 V/μm. On the other hand, when the thickness of the film is thicker than 80 μm, problems such as an increase in the residual voltage, decrease in the light responsive characteristic, a degradation of resolution and so on, are apt to occur.

In a high speed print process, the addition of a halogen impurity, such as iodine, chlorine or the like, is effective, and the amount of the additive is preferably above 1 ppm and below 500 ppm. When the amount of the additive is less than 1 ppm, the light response characteristic will be low because of the small effect produced by the impurity addition, and so a sufficient developing contrast voltage cannot be obtained in a high speed process, such as a process having exposure-to-developing time of 100 milliseconds or less, and a particularly large affect appears under a low temperature condition. Further, when the amount of the additive is more than 500 ppm, a decrease in the charging ability and a decrease in the dark decay characteristic will occur because the film resistance (volume resistivity) of the photosensitive body greatly decreases.

In the image forming apparatus in accordance with the present invention, an electrostatic latent image is formed on a photosensitive drum through an electrostatic applying method and a light exposing method. As for the electrostatic applying method, a comparatively uniform charge distribution can be produced on the surface of the photosensitive body through a charging method utilizing corona discharge, such as by a corotron or a scorotron.

Then, an image to be formed is proposed on the surface of the photosensitive body using the exposing light source. At this time, the charge on the surface of the photosensitive body irradiated with the light is extinguished by electrons or positive holes produced by a photoelectron effect inside the photosensitive layer and an electrostatic latent image is formed on the irradiated surface of the photosensitive body. After that, the electrostatic latent image is changed to a visible image by electrostatically attaching toner to the charged surface in the developing unit. Then, the visible image is transferred onto paper in the transferring unit. The toner and the electrostatic latent image remaining on the surface of the photostatic body are removed by following discharging and cleaning processes, and the photosensitive body is ready for charging for the next printing operation.

In recent years, OPC, which provides an advantage in manufacturing cost, is growing to be widely used for the photosensitive material employed in the electrostatic applying method. However, some high speed printers and high speed copiers, such as line printers and the like, employ $As_2Se_3$ photosensitive materials. The reason for this is that the $As_2Se_3$ photosensitive body has a high surface hardness and is of a single layer structure, and in addition, the $As_2Se_3$ photosensitive body has a better abrasion resistive characteristic against paper and the developing agent in the high speed print process and a better environmental resistive characteristic, especially a better high temperature characteristic. However, the $As_2Se_3$ photosensitive material and the a-Si photosensitive material having a better abrasion resistive characteristic also have a small volume resistivity, which is smaller than those of OPC and SeTe photosensitive materials by two to four orders of magnitude (the volume resistivity of $As_2Se_3$ photosensitive material is $1\times10^{11}\Omega\cdot$cm, and therefore there are problems in that the charge holding ability of the photosensitive body is low, the charge on the surface of the photosensitive body easily leaks and the dark decay of the surface voltage is also large. In other words, the contrast voltage capable of holding a latent image decreases while an electrostatic latent image formed in the exposing portion reaches the transferring portion through the developing process. As a result, the electric field holding the toner electrostatically attached onto a low voltage portion of the electrostatic latent image becomes small, and, accordingly, a disorder in the toner image is apt to occur. That is, a degradation of the resolution of the image is apt to occur in the transfer portion. An embodiment of an image forming apparatus having an $As_2Se_3$ photosensitive body will be described below.

FIG. 1 is a schematic diagram showing the construction of an embodiment of an image forming apparatus in accordance with the present invention. The reference character 1 in the figure denotes a photosensitive drum, which has a diameter of 150 mm to 400 mm and is rotated at a peripheral speed (process speed: $V_p$) of 500 to 200 mm/second. Around the photosensitive drum 1, there are arranged a charger 2, a developing unit 3, a transferring unit 4, an AC discharger 5, an erasing lamp 6 and a cleaning unit 7, such as a cleaning brush, a cleaning blade, a blower or the like.

A paper supply retractor 8 is arranged under the transfer unit 4, and a paper exhausting retractor 9 is arranged above the transfer unit 4. In the upper right side of the photosensitive drum 1 in the figure, there is provided a scanner unit 10 composed of an exposing light source of a semiconductor laser, an LED or a gas laser, a polygon mirror, a lens and so on.

The charging time of the $As_2Se_3$ photosensitive body or the a-Si photosensitive body is set to 30 milliseconds to 300 milliseconds, preferably 50 milliseconds to 200 milliseconds. By doing so, a uniform charge distribution can be obtained and the amount of dark decay after charging can be suppressed, and at the same time a practical sized charger can be obtained.

The writing light X from the scanner unit 10 is irradiated onto the photosensitive drum 1, which has been uniformly charged by the charger 2, to form an electrostatic latent image on the photosensitive drum 1. The electrostatic latent image is moved toward the developing unit 3 as the photosensitive drum 1 is rotated and is supplied with toner from the developing unit 3 to produce a toner image. The toner image on the photosensitive drum 1 is transferred onto paper 11 by the transfer unit 4. The paper 11 is conveyed toward the transfer unit 4 and the photosensitive drum 1 by the paper supplying retractor 8, and the paper 11 with the completed transfer image is conveyed to a fixing unit, not shown, by the paper exhausting retractor 9 and the toner image is fixed to form a permanent image.

The surface charge which remains on the photosensitive drum 1 after image transferring is discharged by the erasing lamp 6, and then the remaining toner is removed by the cleaning unit 7, so that the photosensitive drum 1 is ready for the next image forming. The erasing lamp 6 may be arranged between the transfer unit 4 and the AC discharger 5, and this arrangement is preferable for suppressing the occurrence of the after-image phenomenon. The wavelength $\lambda_1$ of the erasing light is preferably less than 780 nm for an $As_2Se_3$ photosensitive body and an a-Si photosensitive body, and more preferably is less than 680 nm. When the wavelength $\lambda_0$ of the writing light is within the range of $\lambda_0-100$ nm$\leqq\lambda_1\leqq\lambda_0+50$ nm, it is possible to effectively suppress after image and light fatigue, and it is particularly effective when the wavelength $\lambda_0$ of the writing light is within the range of 600 nm$\leqq\lambda_0\leqq$680 nm.

In the figure, a first developing roll 3*a*, a second developing roll 3*b* and a third developing roll 3*c* are arranged in the rotating direction of the photosensitive drum 1 from the upstream side to the downstream side in the order of the first developing roll 3*a*, the second developing roll 3*b* and the third developing roll 3*c*. The reference character 12 represents toner, and the reference characters 13, 14, 15, 16 represent voltage sensors arranged in predetermined positions.

Figure 2:
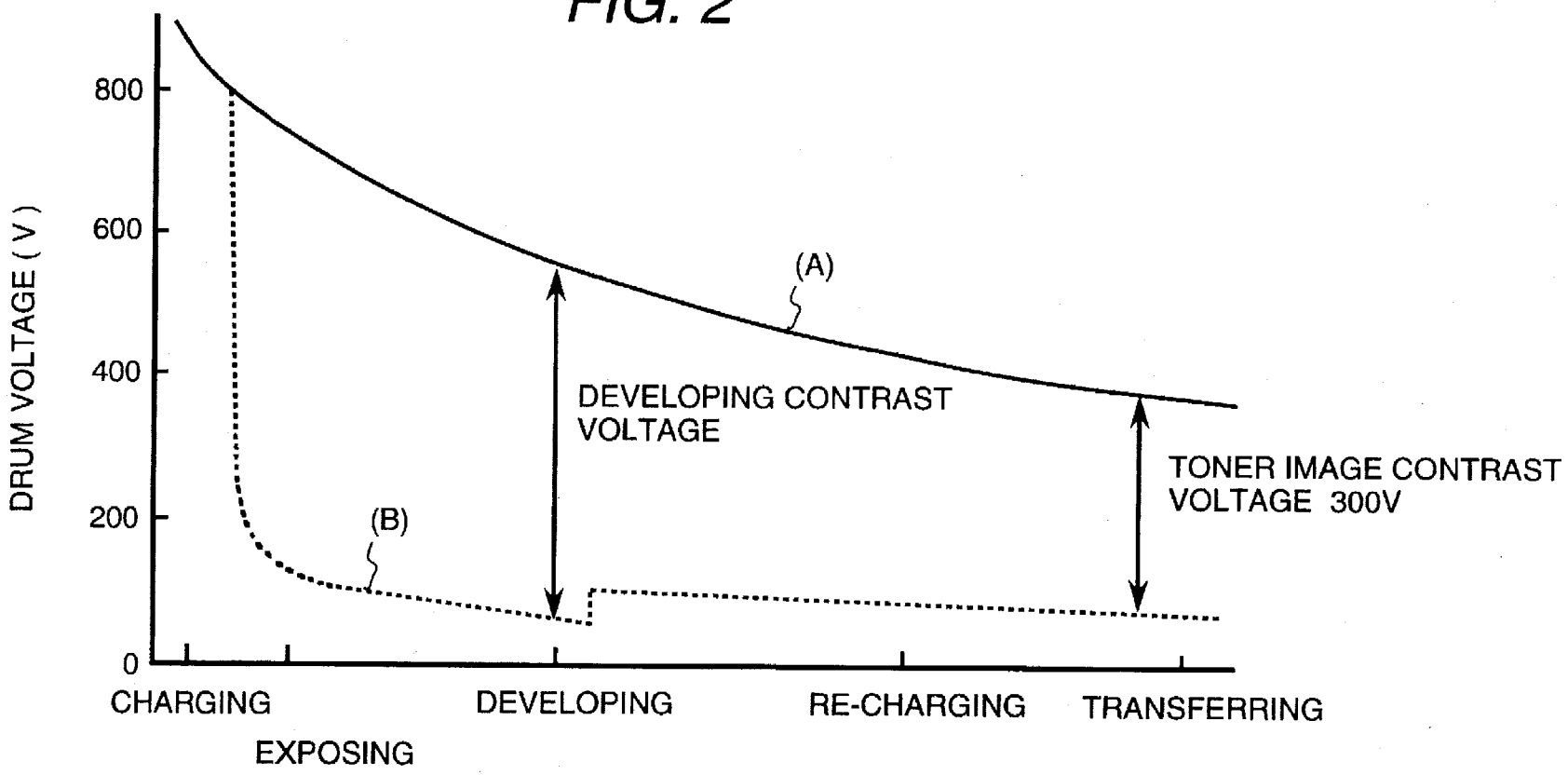
FIG. 2 is a graph showing the characteristic of a drum voltage in each of successive image forming processes.

FIG. 2 is a graph showing the change in the surface voltages of the $As_2Se_3$ photosensitive drum 1 in the image forming process. The abscissa of the figure shows the image forming processes of charging, exposing, developing, re-charging and transferring, and the ordinate shows the surface voltage of the photosensitive drum. The solid line in the figure indicates the surface voltage in the non-exposed portion and the dotted line in the figure indicates the surface voltage in the exposed portion. The difference in the surface voltages between the non-exposed portion and the exposed portion at the developing time is a developing contrast voltage and the difference in the surface voltages between the non-exposed portion and the exposed portion just before the transferring time is a toner image contrast voltage.

As can be understood from the voltage change in the non-exposed portion shown by the solid line, the surface voltage of the photosensitive body after charging decreases exponentially, and the voltage drops by 400 V in a period of 0.5 second from charging to transferring. The contrast voltage of 700 V just after exposing becomes approximately 300 V just before transferring, and the latent image collapses because of a large dark decay.

Figure 3:
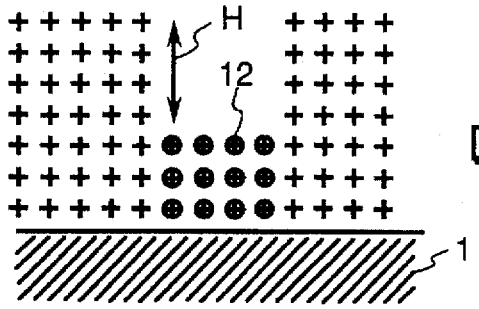
FIGS. 3(*a*) and 3(*b*) are diagrams for explaining collapse of an toner image just before transferring.
Figure 3:
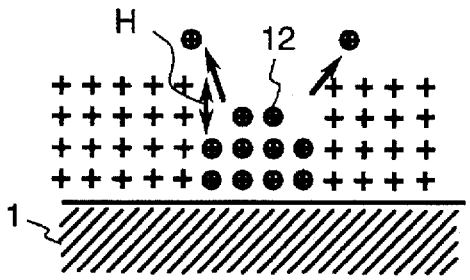

FIGS. 3(*a*) and 3(*b*) are views showing the relationship between the collapse of a latent image and a toner image. FIG. 3(*a*) shows a state wherein there is no collapse of the latent image just after developing, and FIG. 3(*b*) shows a state where there is a collapse of the latent image just before transferring. The height H of an electrostatic wall for preventing disturbance of a toner image attached to the electrostatic latent image is high in the state where there is no collapse of the latent image, as shown in FIG. 3(*a*), but the latent image collapses when the height H of the wall is steeply decreased due to a large dark decay, as shown in FIG. 3(*b*). Therefore, when the toner image is transferred to paper, the toner is easily blown off by scraping with the paper and accordingly the image quality, such as the resolution, is degraded.

In a case where red light, that is, long wavelength light, such as provided by a semiconductor laser or LED, is used as a latent image writing light or discharging light, the charge holding force of the photosensitive body is further decreased. The reason for this is that, since long wavelength light penetrates deeply into the photosensitive body to a significant distance and the position of the light carrier produced in the photosensitive layer is also deep, the produced light carrier is apt to remain in the photosensitive body during a short process time, such as occurs in a high speed printing.

In accordance with the present invention, the dark decay characteristic of the photosensitive body voltage and the deviation in the photosensitive body voltage are improved by optimizing the charging time in connection with the charging condition, and a compatibility between the image concentration and the fog level is attained by optimizing the developing time and the developing bias in connection with the developing condition. In order to decrease the light fatigue of the photosensitive body, that is, the after-image phenomenon and degradation in the dark decay characteristic, the writing light and the charge erasing light conditions are optimized.

Figure 4:
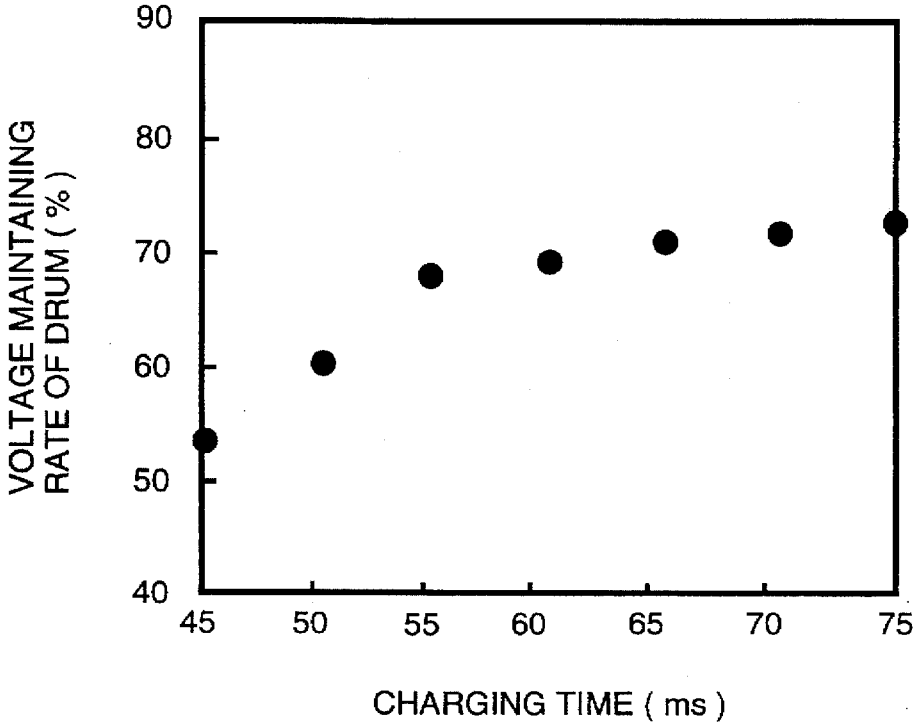
FIG. 4 is a characteristic graph showing the relationship between charging time and a voltage maintaining rate of a drum.

FIG. 4 shows the relationship between charging time and the drum voltage maintaining rate, in regard to the charging condition. This test was conducted under the condition wherein an LED having a wavelength of 600 nm (light quantity: 300 $\mu W/cm^2$) was used as an erasing light source and an $As_2Se_3$ photosensitive material with added iodine of 20 ppm was used as the photosensitive body, and the voltage holding rate of the drum for each charging time was measured. In a case where the charging time is, for example, 55 milliseconds, the voltage holding rate of the drum is a value which is obtained by charging at a drum voltage of 800 V ($V_0$) for 55 milliseconds and measuring the drum voltage ($V_1$) after 300 milliseconds has elapsed, and then calculating the voltage holding rate using the equation $V_1/V_0 \times 100$. In this case, the voltage holding rate of the drum was 70%.

It can be understood from FIG. 4 that when the charging time is shorter than 55 milliseconds, the voltage holding rate of the drum is steeply decreased. On the other hand, when the charging time is longer than 55 milliseconds, the voltage holding rate of the drum is nearly the same value. The upper limit of the charging time is approximately 200 milliseconds due to the construction of the apparatus. Nearly the same characteristic has been obtained when varying the test conditions, such as the shape of the charger, the charging current, the erasing condition, and the impurity amount added to the photosensitive material (1 to 500 ppm). Since an $As_2Se_3$ photosensitive body has a comparatively large dark decay, it is possible to maintain the resolution and decrease the fog level by maintaining the voltage holding rate of the drum at 300 milliseconds after charging above 70%.

Figure 5:
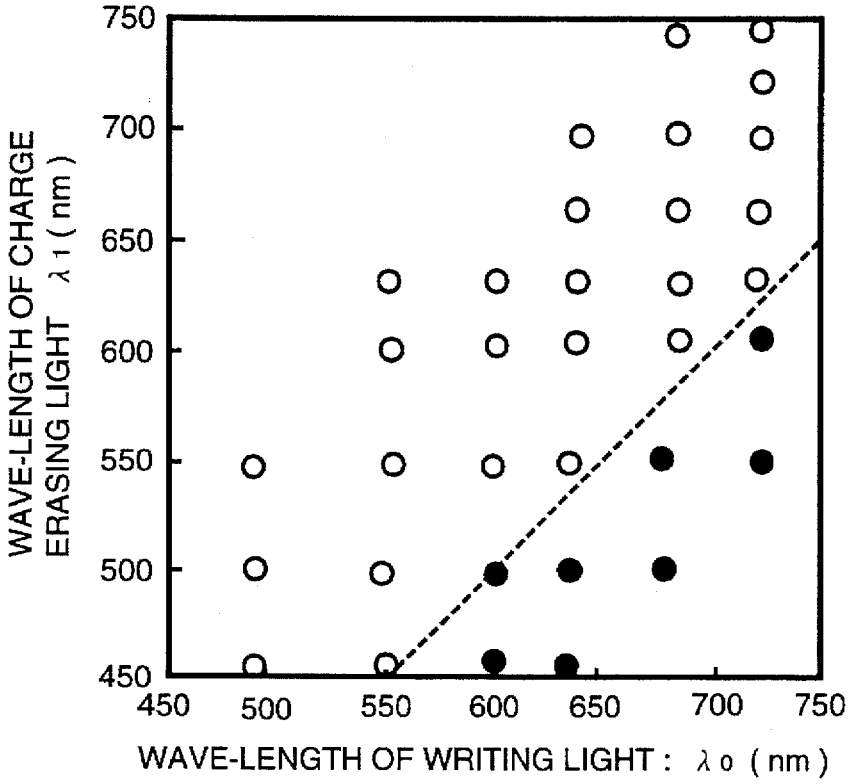
FIG. 5 is a characteristic graph showing the relationship between the wavelength of the writing light and the wavelength of the charge erasing light.

FIG. 5 is a characteristic graph showing the relationship between the wavelength of the writing light and the wavelength of the charge erasing light. This test was conducted under the condition that the amount of writing light was set to 4 times as much as the half-decay exposure light quantity of the $As_2Se_3$ photosensitive material, and the amount of erasing light was set to 16 times as much as the half-decay exposure light quantity of the $As_2Se_3$ photosensitive material. An evaluation of the after-image was performed by printing a one-inch solidly shaded image followed by printing horizontal line images spaced every one-line, and then by performing a visual inspection to detect the presence or absence of an after-image.

In FIG. 5, the hollow circle mark ○ indicates a result where an after-image was not observed and the solid circle mark ● indicates a result where an after-image was observed. It can be understood, the figure that the occurrence of an after-image can be prevented the relationship between the wavelength of the writing $\lambda_0$ and the wavelength of the erasing light $\lambda_1$ satisfies the relation $\lambda_1 \geqq \lambda_0 - 100$ nm.

Figure 6:
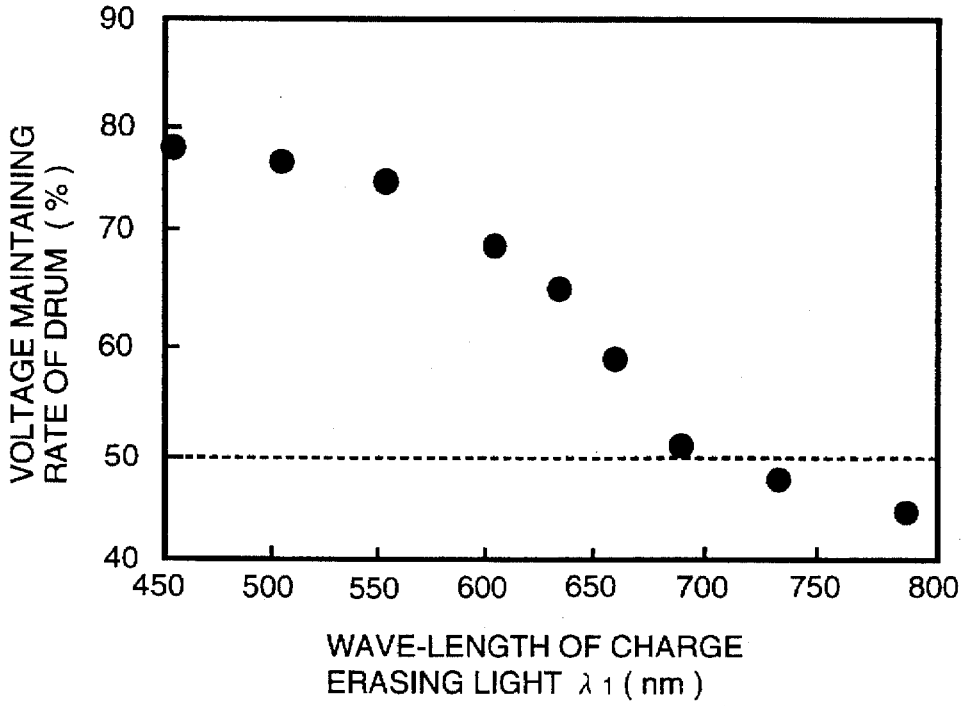
FIG. 6 is a characteristic graph showing the relationship between the wavelength of the charge erasing light and the voltage maintaining rate of a drum.

FIG. 6 shows the relationship between the wavelength of the charge erasing light and the voltage maintaining rate of the drum. The voltage maintaining rate of the drum in this test is a value which is obtained by using a drum voltage $V_A$ just after exposure measured by the voltage sensor 13 shown in FIG. 1 and a drum voltage $V_B$ just after development measured by the voltage sensor 14 and by calculating the voltage ratio according to the relation ($V_B/V_A \times 100$). The process time between the voltage sensor 13 and the voltage sensor 14 was approximately 300 milliseconds.

It can be understood from FIG. 6 that the voltage maintaining rate of the drum decreases as the wavelength of the erasing light increases, and the voltage maintaining rate of the drum becomes lower than 50% when the wavelength becomes larger than 680 nm, and so it is difficult to keep a sufficient contrast voltage of nearly 300 V in the transferring portion. Therefore, it is necessary to use an erasing light having a wavelength smaller than 680 nm.

Figures 7, 8:
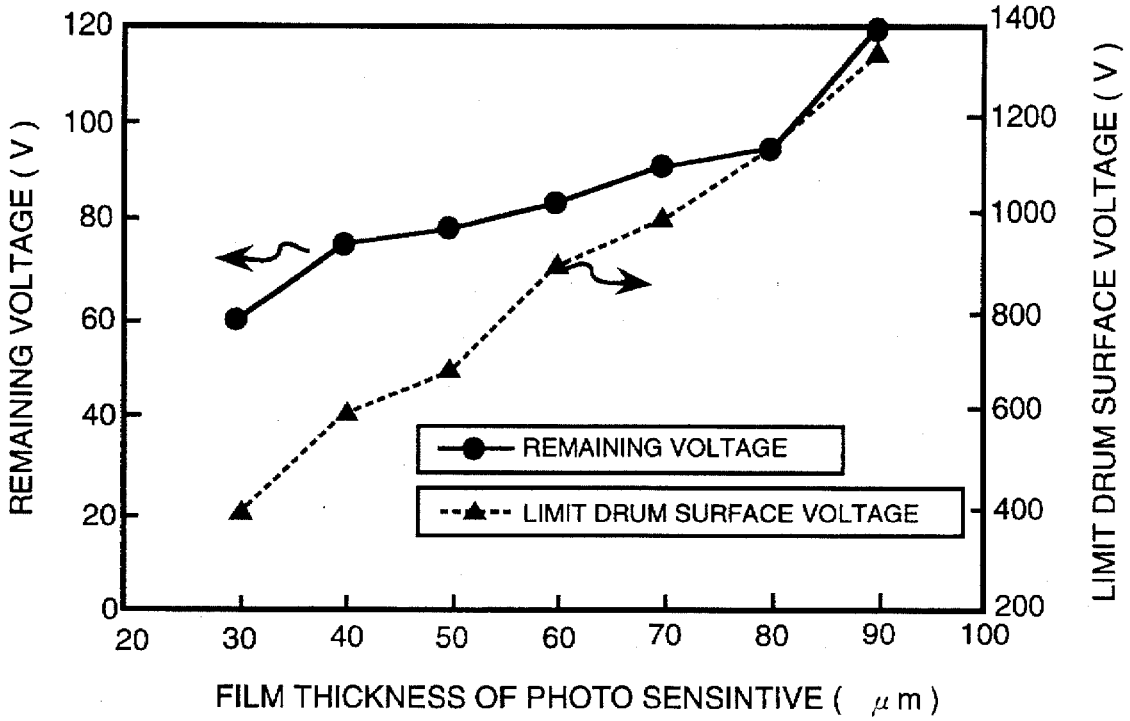
FIG. 7 is a characteristic graph showing the relationship between the film thickness of a photosensitive body and the remaining voltage, limit drum surface voltage.
FIG. 8 is a table showing the effect of iodine addition.

FIG. 7 shows the relationship between the film thickness of the photosensitive body and the remaining voltage, the limit drum surface voltage. This test was conducted under the condition that measurements of the remaining voltage and the limit drum surface voltage were performed using the voltage sensor 14 shown in FIG. 1. The solid circle mark ● indicates the remaining voltage and the solid triangle ▲ indicates the limit drum surface voltage.

It can be understood from FIG. 7 that the remaining voltage and the limit drum surface voltage increase as the film thickness of the photosensitive body increases. Since the increase in the remaining voltage results in a decrease in the image darkness, it is preferable for the remaining voltage to be lower than 100 V. Therefore, it is required to limit the film thickness of the photosensitive body to a value below 80 μm. The limit drum surface voltage refers to a surface voltage which can be stably used without dielectric breakdown, such as pin hole formation. Therefore, in order to obtain a sufficient contrast voltage, that is, nearly above 400 V at the developing portion, it is required that the film thickness of the photosensitive body is more than 40 μm. The same result was obtained when the a-Si photosensitive body was used. Thus, it is necessary for the film thickness of the photosensitive body to be within the range of 40 μm to 80 μm, and preferably within the range of 50 μm to 75 μm.

In order to improve the light responsive characteristic of the $As_2Se_3$ photosensitive material used for a high speed process, it is effective to add a halogen, such as iodine, chlorine and the like, to the $As_2Se_3$ photosensitive material. FIG. 8 is a table showing the relationship between the added amount of iodine and the electro-photographic characteristics of the initial voltage, remaining voltage, voltage holding rate and light response time.

It can be understood from FIG. 8 that the light response time was substantially improved by addition of a small amount of iodine (above 1 ppm), but the charging ability and the voltage holding rate are decreased as the amount of additive is increased. When the amount of added iodine exceeds 500 ppm, the voltage holding rate of the drum falls below 50% and it is difficult to maintain a sufficient contrast voltage. This phenomenon also takes place when another halogen, such as chlorine, is added. Therefore, it is necessary to limit the halogen quantity to 1 ppm to 500 ppm.

Figure 9:
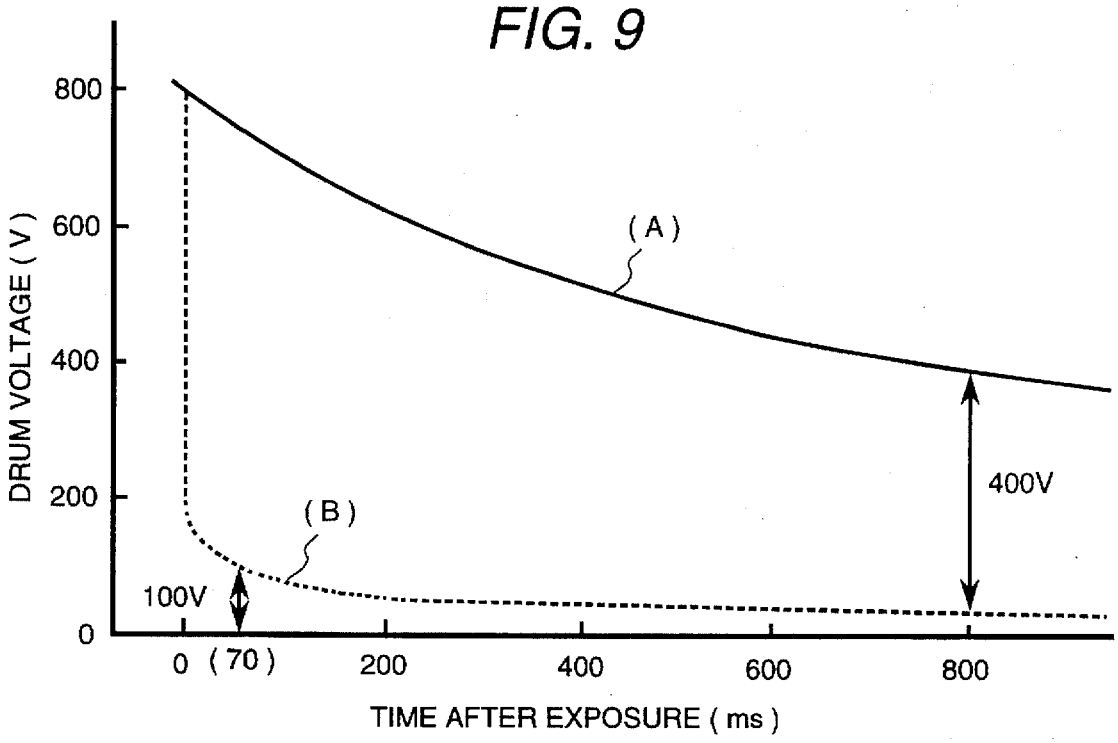
FIG. 9 is a characteristic graph showing the change in drum voltage after exposure.

FIG. 9 shows a dark decay curve (A) of a non-exposed portion of an $As_2Se_3$ photosensitive body and a light decay curve (B) of an exposed portion. The measuring condition was that the wavelength of the writing light was 680 nm and the amount of light was 7 $\mu W/cm^2$, and an $As_2Se_3$ photosensitive material with added iodine in an amount of 50 ppm was used for the photosensitive body.

It can be understood from the light decay curve (B) that it requires more than 70 milliseconds after exposing to stabilize the remaining voltage which becomes below nearly 100 V. When the time after exposing exceeds 800 milliseconds, the drum voltage of the non-exposed portion falls below 400 V due to the dark decay of the surface voltage, and an image fault, such as fog, is apt to appear due to lack of a sufficient contrast voltage. Therefore, it is necessary for the process time $T_1$ from exposing to starting of development to be more than 70 milliseconds.

Figure 10:
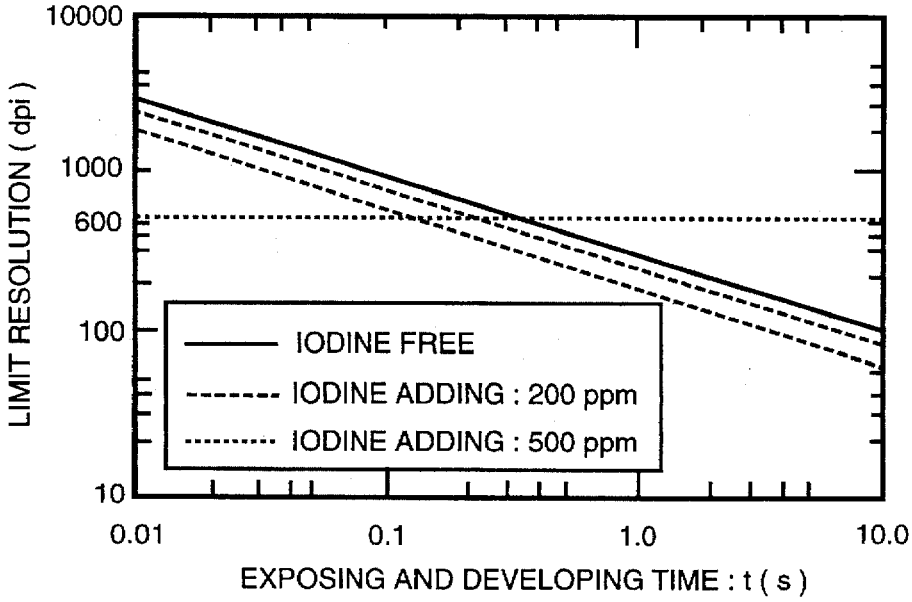
FIG. 10 is a characteristic graph showing the relationship between exposing and developing time and limit resolution.

FIG. 10 shows the relationship between the time from exposing to developing and the limit resolution. This test was conducted under the condition that an $As_2Se_3$ photosensitive body was used, a semiconductor laser having a wavelength of 680 nm was used as the writing light source, and an LED having a wavelength of 600 nm and a light amount of 300 μW/cm$^2$ was used for the erasing light source. As for the developing condition, a developing machine having three developing rolls was used, a two-component developing agent was used for the developing agent, and a styrene-acrylic toner having an average grain size of 11 μm was used for the toner. The surface voltage on the photosensitive surface at a position just before the developing machine was set to nearly 800 V, and the developing contrast voltage was set to 300 V. As for the photosensitive body, photosensitive bodies made of an $As_2Se_3$ photosensitive material containing 20 ppm iodine, an $As_2Se_3$ photosensitive material containing 500 ppm iodine and an iodine-free $As_2Se_3$ photosensitive material were used, and the surface roughness of the photosensitive bodies was set to 0.75 μm.

The evaluation of the resolution was performed using a dot reproducing evaluation method by measuring a modulation function (MF) value. The modulation function here is a method of measuring the contrast of an image by degree of modulation in which the image density of a one-dot-on one-dot-off image is measured using a micro-densitometer and average values of $D_{max}$ and $D_{min}$ for high density values and low density values are obtained in taking an average value of the whole measured values as the reference value, and a modulation function (MF) value is calculated using the following equation.

$$MF\ \text{value}=(D_{max}-D_{min})/(D_{max}+D_{min})\times 100\ (\%)$$

Therefore, the dot reproducibility is better as the MF value is larger, and in this evaluation it is judged acceptable when the MF value is above 50%. The target value for the resolution is determined to be 600 dpi.

It can be understood from FIG. 10 that the obtained limit resolution becomes smaller as the time from exposing to developing is longer. The reason for this is that the dot latent image formed on the photosensitive body collapses as time passes, and accordingly the reproducibility is decreased. It can be also understood that the limit resolution under a fixed time from exposing to developing is decreased as the amount of added halogen, in this case iodine, is increased. The reason for this is that the resistivity of the photosensitive material is decreased by adding the halogen, and consequently the latent image is easily collapsed. It can be understood from the results of FIG. 10 that the time from exposing to developing is set within 300 milliseconds in order to obtain the resolution target value of 600 dpi.

Figures 11, 12:
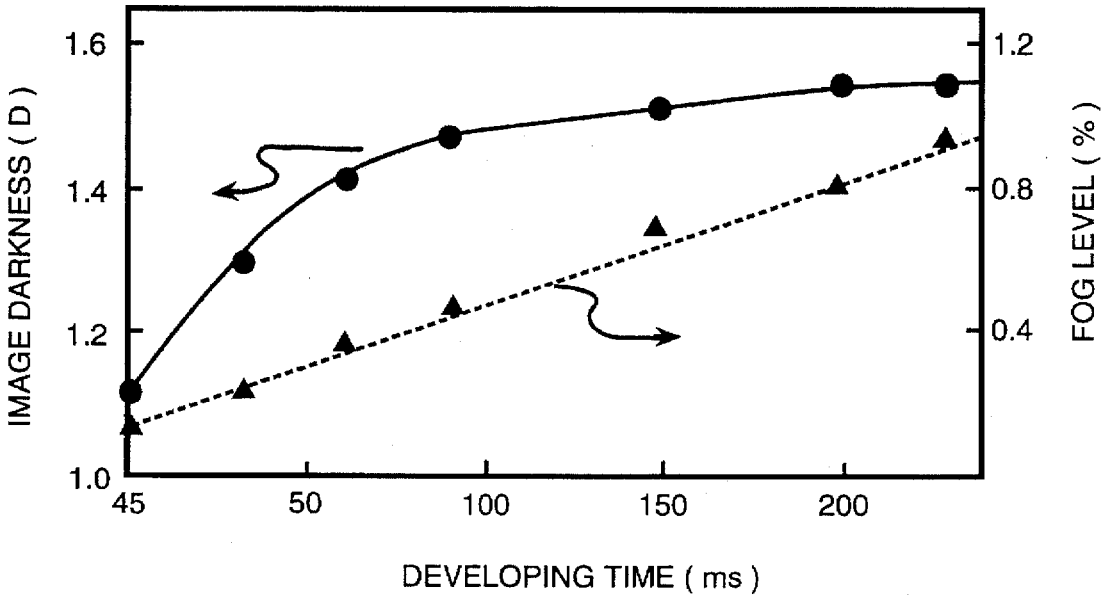
FIG. 11 is a characteristic graph showing the relationship between developing time and image darkness, fog level.
FIG. 12 is a table showing the relationship between developing bias voltage and image density, fog level.

FIG. 11 shows the relationship between the developing time (in the case of plural developing rolls, the sum of the developing time is used) and the image darkness, the fog level. The solid circle mark ● indicates the relationship between the developing time and the image darkness, and the solid triangle mark ▲ indicates the relationship between the developing time and the fog level. A evaluation of the image darkness was performed by measuring the reflection of a solidly shaded print sample image using a measuring instrument (trade name: Macbeth Reflection Densitometer, a product of Graphics Microsystems Inc.), and evaluation of the fog was performed by comparing the evaluation of a white print sample and an unused print paper sheet using a measuring instrument (trade name: Hunter Densitometer, a product of Hunter Associates Laboratory Inc.).

As shown in the figure, although the image density becomes above 1.4 (D) when the developing time is above 50 milliseconds, the fog level also increases as the developing time is increased. The fog level becomes above nearly 0.8% when the developing time exceeds 200 milliseconds. Therefore, it is required to limit the developing time within the range of 50 milliseconds to 200 milliseconds, and preferably within the range of 60 milliseconds to 100 milliseconds.

FIG. 12 shows the relationship between the developing bias voltage and the image density, the fog level. This test was conducted under the condition that a developing machine having three developing rolls 3*a* to 3*c* as shown in FIG. 1 was used, a two-component developing agent was used for the developing agent, and a styrene-acrylic toner having an average grain size of 11 μm was used for the toner. The surface voltage on the photosensitive surface at a position just before the developing machine was set to nearly 750 V.

The image density and the fog level were studied by varying the developing bias voltages applied to the three developing rolls, i.e. to the first roll, the second roll and the third roll. As a result, it was established that the fog level can be decreased by decreasing the developing bias voltage in the rotating direction of the photosensitive body to the downstream side, as shown in the table.

Figure 13:
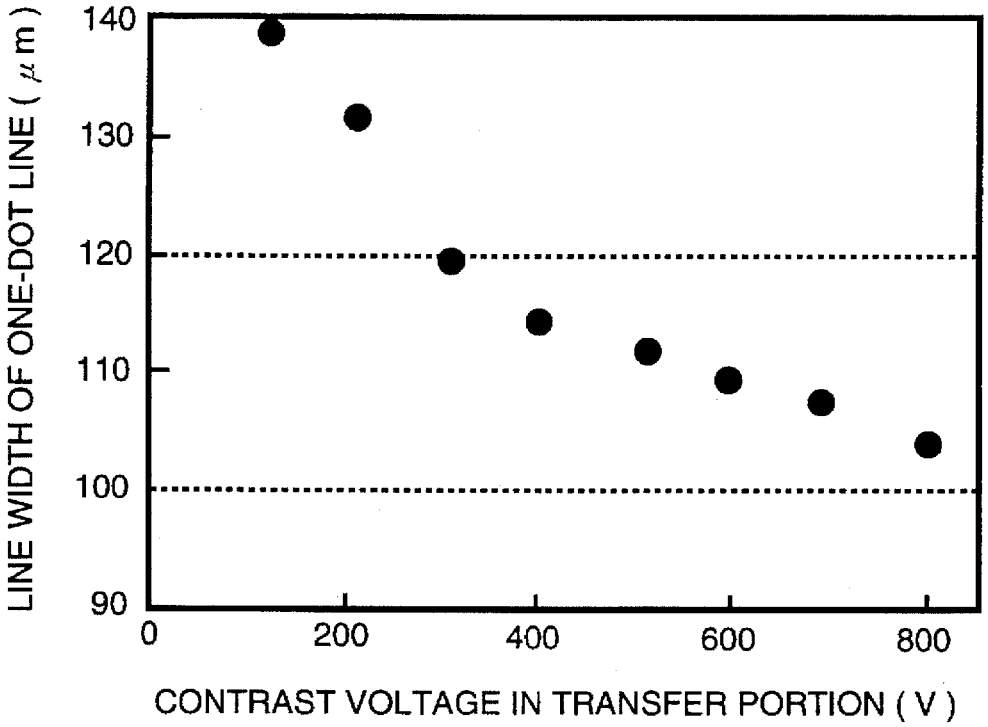
FIG. 13 is a characteristic graph showing the relationship between the contrast voltage in a transfer portion and the line width of a line.

FIG. 13 shows the relationship between the contrast voltage in the transfer portion and the line width of a one-dot line. This measurement was conducted by using the apparatus shown in FIG. 1 and measuring the contrast voltage using the voltage sensor 15 shown in FIG. 1. The spot diameter of the writing light on the drum surface was approximately 100 μm and an optical system equivalent to 240 dpi was used.

It can be understood from the figure that the line width becomes wider and the resolution is decreased as the contrast voltage in the transfer portion is decreased. Since the line width slightly grows depending on the developing condition, it can be understood that the line width of the one-dot line becomes below 120 μm when the limit line width is set to 120 μm and the contrast voltage in the transfer portion is set to above 300 V.

Figure 14:
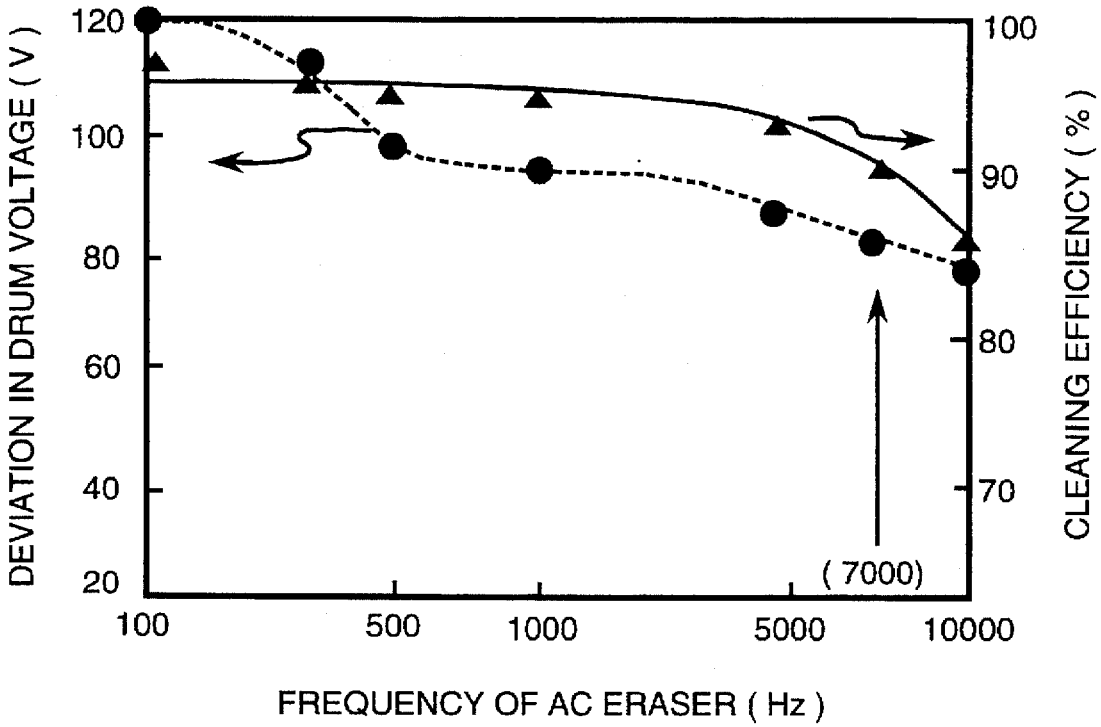
FIG. 14 is a characteristic graph showing the relationship between the frequency of an AC eraser and the deviation in drum voltage, cleaning efficiency.

FIG. 14 shows the relationship between the frequency of the AC discharger and the deviation in drum voltage, the cleaning efficiency. This test was performed under the condition that the voltage applied to the AC discharger was approximately 5 kV in effective value, and the deviation in drum voltage was measured using the voltage sensor 16 shown in FIG. 1. The solid circle mark ● indicates the relationship between the frequency of the AC discharger and the deviation in drum voltage, and the solid triangle mark ▲ indicates the relationship between the frequency of the AC discharger and the cleaning efficiency.

As shown in the figure, when the frequency of the AC discharger is smaller than 500 Hz, the deviation in drum voltage steeply increases to 100 V or more. As the frequency of the AC discharger increases, the cleaning efficiency gradually decreases, and when the frequency of AC discharger exceeds 7000 Hz, the cleaning efficiency decreases to below 85%. When the applied voltage was within the range of 2 kV to 7 kV, the above trend was the same. From the results, it is necessary for the frequency of AC discharger to be within the range of 500 Hz to 7000 Hz, and preferably within the range of 500 Hz to 2000 Hz.

Embodiments of the present invention will be described below. Firstly, a first embodiment will be described below.

In the image forming apparatus shown in FIG. 1, an InGaAlP/GaAs semiconductor laser having a wavelength of 680 nm was used and the amount of exposing light was set to 6 mW on the surface of the photosensitive drum 1. The photosensitive drum 1, which had an outer diameter of 262 mm, a length of 430 mm and a film thickness of 60 μm, employed an $As_2Se_3$ photosensitive material with iodine added in the amount of 20 ppm in order to improve the light responsive characteristic. The rotating speed of the photosensitive drum 1 was 60 rpm and the process time between the charger 2 and the developing machine 3 was nearly 180 milliseconds.

The image forming in accordance with the present invention was executed as follows. Initially, the photosensitive drum 1 was charged to approximately +800 V in surface voltage by applying a voltage of approximately +7.5 kV to the charger 2. The diameter of the corona wires of the charger was 70 μm. The distance between the wires was about 10 mm and the distance between the wire and the drum was also about 10 mm. The width of the charger 2 in the direction of drum periphery was set to 80 mm.

Next, image exposure was performed using the scanner unit 10 to form a latent image on the photosensitive drum 1. The spot diameter for the laser exposure in this embodiment was nearly 70 μm which was equivalent to a resolution of 480 dpi. A multi-stage developing machine having three developing rolls 3*a* to 3*c* was used, and the diameter of each of the developing rolls was 50 mm, and the developing time was set to nearly 90 milliseconds. A two-component developing agent was used for the developing agent, and a styrene-acrylic toner having an average grain size of 11 μm was used for the toner. The developing bias voltage was set to 400 V/350 V/300 V in the rotating direction of the photosensitive drum 1 from the upstream side to the downstream side.

The toner image produced by the developing machine 3 was transferred to the paper 11 by the transferring unit 4. The transferring voltage was set to nearly −6.0 kV. Then, the remaining toner which was not transferred was discharged by the AC discharger 5 having an alternating current frequency of 500 Hz and an applied voltage of 5 kV, and the electrostatic latent image on the photosensitive drum 1 was discharged by the erase lamp 6 emitting red light having a wavelength of nearly 660 nm and a light quantity of 300 $\mu W/cm^2$ produced by a 15 W white fluorescent lamp through a red filter. Then, the surface of the photosensitive drum 1 was cleaned by the cleaning unit 7 in which cleaning was performed using a fur-brush in this embodiment, and the photosensitive drum 1 was ready for the next image forming operation.

The reference characters 13, 14, 15 in FIG. 1 are surface voltage sensors. The sensor 13 was placed at a position just after exposure, the sensor 14 was placed at a position just after the developing machine and the sensor 15 was placed just before image transferring, and these sensors detected the surface voltages of the photosensitive drum 1. The drum voltages in the above image forming condition were a non-exposed position voltage $V_O$/exposed position voltage $V_R$=800 V/90 V at the position of the sensor 13, 630 V/105 V at the position of the sensor 14 and 500 V/100 V at the position of the sensor 15. At the time 300 milliseconds after charging, the voltage holding rate was 70% and the remaining voltage was 85 V.

Under the above condition, a printing test of about 5000 pages was conducted. As the test result, by the print sample, a high precision image quality having a solidly shaded density of 1.45 (D), a fog level of 0.4% and a resolution equivalent to 480 dpi was obtained. Further, this quality was maintained for a long period, and a practical image could be obtained in a printing test of 3 million pages.

A second embodiment will be described below.

In this embodiment, a red LED having a wavelength of 680 nm was used as the writing light source and the amount of exposing light was set to 6 mW on the surface of the photosensitive drum 1. The photosensitive drum 1, which had an outer diameter of 262 mm, a length of 430 mm and a film thickness of 40 μm, employed an $As_2Se_3$ photosensitive material with iodine added in an amount of 300 ppm in order to improve the light responsive characteristic. The rotating speed of the photosensitive drum 1 was 60 rpm and the process time between the charger 2 and the developing machine 3 was nearly 150 milliseconds. The width of the charger 2 was 110 mm, and the charging time of the photosensitive body was set to nearly 133 milliseconds. The spot diameter of the LED exposing light was nearly 40 μm and the resolution was equivalent to 600 dpi.

The same type of developing machine 3 as used in the first embodiment was used, and the developing time was set to nearly 95 milliseconds. A two-component developing agent was used for the developing agent, and a styrene-acrylic toner having an average grain size of 7 μm was used for the toner 12. The developing bias voltage was set to 400 V/350 V/300 V in the rotating direction of the photosensitive drum 1 from the upstream side to the downstream side. An LED having a wavelength of 660 nm and a light quantity of 400 $\mu W/cm^2$ was employed as the erase lamp 6.

Under the image forming condition where the other conditions were set to be the same as in the first embodiment, a printing test of about 5000 pages was conducted. The drum voltages in the above image forming condition were a non-exposed position voltage $V_O$/exposed position voltage $V_R$=800 V/80 V at the position of the sensor 13, 630 V/100 V at the position of the sensor 14 and 510 V/100 V at the position of the sensor 15. At the time 300 milliseconds after charging, the voltage holding rate was 70% and the remaining voltage was 75 V. By the print sample, a high precision image quality having a solidly shaded density of 1.45 (D), a fog level of 0.45% and a resolution equivalent to 600 dpi was obtained. Further, this quality was maintained for a long period, and practical image could be obtained in a printing test of 3 million pages.

A third embodiment will be described below.

In this embodiment, a He-Ne laser having a wavelength of 635 nm was used as the writing light source and the amount of exposing light was set to 6 mW on the surface of the photosensitive drum 1. The photosensitive drum 1, which had an outer diameter of 262 mm, a length of 430 mm and a film thickness of 40 μm, employed an $As_2Se_3$ photosensitive material with iodine added in an amount of 10 ppm in order to improve the light responsive characteristic. The rotating speed of the photosensitive drum 1 was 72 rpm and the process time between the charger 2 and the developing machine 3 was nearly 125 milliseconds.

The image forming in accordance with the present invention was executed as follows. Initially, the photosensitive drum 1 was charged to approximately +800 V in surface voltage by applying a voltage of approximately +8.5 kV to the charger 2. The diameter of the corona wires of the charger was 70 μm. The distance between the wires was about 10 mm and the distance between the wire and the drum was also about 10 mm. The width of the charger 2 in the direction of the drum periphery was set to 110 mm. By doing so, the charging time of the photosensitive body was set to approximately 111 milliseconds.

Next, an image exposure was performed using the scanner unit 10 to form a latent image on the photosensitive drum 1. The spot diameter for the laser exposure in this embodiment was nearly 70 μm which was equivalent to a resolution of 480 dpi.

A multi-stage developing machine having three developing rolls was used, the diameter of each of the developing rolls was 50 mm, and the developing time was set to nearly 80 milliseconds. A two-component developing agent was used for the developing agent, and a styrene-acrylic toner having an average grain size of 11 μm was used for the toner 12. The developing bias voltage was set to 350 V/300 V/250 V in the rotating direction of the photosensitive drum 1 from the upstream side to the downstream side.

The toner image visualized by the developing machine 3 was transferred to the paper 11 by the transferring unit 4. The transferring voltage was set to nearly −6.0 kV. Then, the remaining toner which was not transferred was discharged by the AC discharger 5 having an alternating current frequency of 5 kHz and an applied voltage of 5 kV, and the electrostatic latent image on the photosensitive drum 1 was discharged by the erase lamp 6 emitting red light having a wavelength of nearly 660 nm and a light quantity of 300 $\mu W/cm^2$ produced by a 15 W white fluorescent lamp through a red filter.

The drum voltages in the above image forming condition were a non-exposed position voltage $V_0$/exposed position voltage $V_R$=800 V/85 V at the position of the sensor 13, 680 V/105 V at the position of the sensor 14 and 550 V/100 V at the position of the sensor 15. Under the above condition, a printing test of about 5000 pages was conducted. As the test result, by the print sample, a high precision image quality having a solidly shaded density of 1.45 (D), a fog level of 0.4% and a resolution equivalent to 480 dpi was obtained. Further, this quality was maintained for a long period, and a practical image could be obtained in a printing test of 3 million pages.

A fourth embodiment will be described below.

In this embodiment, an Ar laser having a wavelength of 488 nm was used as the writing light source and the amount of exposing light was set to 8 mW on the surface of the photosensitive drum 1. The photosensitive drum 1, which had an outer diameter of 262 mm, a length of 430 mm and a film thickness of 50 μm, employed an $As_2Se_3$ photosensitive material with iodine added in an amount of 3 ppm in order to improve the light responsive characteristic. The rotating speed of the photosensitive drum 1 was 80 rpm and the process time between the charger 2 and the developing machine 3 was nearly 120 milliseconds. The width of the charger 2 was 110 mm, and the charging time of the photosensitive body was set to nearly 100 milliseconds. The spot-diameter of the LED exposing light was nearly 40 μm and the resolution was equivalent to 600 dpi.

A multi-stage developing machine having four developing rolls was used, and the diameter of each of the developing rolls was 50 mm, and the developing time was set to nearly 90 milliseconds. A two-component developing agent was used for the developing agent, and a styrene-acrylic toner having an average grain size of 7 μm was used for the toner 12. The developing bias voltage was set to 400 V/350 V/300 V/250 V in the rotating direction of the photosensitive drum 1 from the upstream side to the downstream side. The erase lamp 6 emitted light having a wavelength of nearly 450 nm and a light quantity of 250 $\mu W/cm^2$ produced by a 15 W white fluorescent lamp through a blue filter (BPB45).

Under the image forming condition where the other conditions were set to be the same as in the third embodiment, a printing test of about 5000 pages was conducted. The drum voltages in the above image forming condition were a non-exposed position voltage $V_0$/exposed position voltage $V_R$=800 V/75 V at the position of the sensor 13, 700 V/85 V at the position of the sensor 14 and 610 V/85 V at the position of the sensor 15. By the print sample, a high precision image quality having a solidly shaded density of 1.50 (D), a fog level of 0.3% and a resolution equivalent to 600 dpi was obtained. Further, this quality was maintained for a long period, and a practical image could be obtained in a printing test of 3 million pages.

A fifth embodiment will be described below.

In this embodiment, four semiconductor lasers arranged in an array having a wavelength of 635 nm were used as the writing light source and the amount of exposing light was set to 8 mW on the surface of the photosensitive drum 1. The photosensitive drum 1, which had an outer diameter of 262 mm, a length of 430 mm and a film thickness of 50 μm, employed an $As_2Se_3$ photosensitive material with iodine added in an amount of 50 ppm in order to improve the light responsive characteristic. The rotating speed of the photosensitive drum 1 was 80 rpm and the process time between the charger 2 and the developing machine 3 was nearly 120 milliseconds. The width of the charger 2 was 80 mm, and the charging time of the photosensitive body was set to nearly 73 milliseconds. The spot diameter of the LED exposing light was nearly 40 μm and the resolution was equivalent to 600 dpi.

A multi-stage developing machine having four developing rolls was used, the diameter of each of the developing rolls was 50 mm, and the developing time was set to nearly 90 milliseconds. A two-component developing agent was used for the developing agent, and a styrene-acrylic toner having an average grain size of 7 μm was used for the toner 12. The developing bias voltage was set to 400 V/350 V/300 V/250 V in the rotating direction of the photosensitive drum 1 from the upstream side to the downstream side. An LED array emitting light having a wavelength of nearly 600 nm and a light quantity of 350 $\mu W/cm^2$ was used as the erase lamp 6.

Under the image forming condition—where the other conditions were set to be the same as in the fourth embodiment, a printing test of about 5000 pages was conducted. The drum voltages in the above image forming condition were a non-exposed position voltage $V_0$/exposed position voltage $V_R$=800 V/85 V at the position of the sensor 13, 660 V/100 V at the position of the sensor 14 and 500 V/100 V at the position of the sensor 15. By the print sample, a high precision image quality having a solidly shaded density of 1.45 (D), a fog level of 0.5% and a resolution equivalent to 600 dpi was obtained. Further, this quality was maintained for a long period, and a practical image could be obtained in a printing test of 3 million pages.

A sixth embodiment will be described below.

In the image forming apparatus shown in FIG. 1, an InGaAlP/GaAs semiconductor laser having a wavelength of 680 nm was used and the amount of exposing light was set to 6 mW on the surface of the photosensitive drum 1. The photosensitive drum 1, which had an outer diameter of 262 mm, a length of 430 mm, a film thickness of 60 μm and a surface roughness of 0.375 μm, employed an $As_2Se_3$ photosensitive material with iodine added in an amount of 20 ppm in order to improve the light responsive characteristic. The rotating speed of the photosensitive drum 1 was 60 rpm and the process time between the charger 2 and the developing machine 3 was nearly 180 milliseconds.

The image forming in accordance with the present invention was executed as follows. Initially, the photosensitive drum 1 was charged to approximately +800 V in surface voltage by applying a voltage of approximately +7.5 kv to the charger 2. The diameter of the corona wires of the charger was 70 μm. The distance between the wires was about 10 mm and the distance between the wire and the drum was also about 10 mm. The width of the charger 2 in the direction of the drum periphery was set to 80 mm.

Next, an image exposure was performed using the scanner unit 10 to form a latent image on the photosensitive drum 1. The spot diameter for the laser exposure in this embodiment was nearly 45 μm which was equivalent to a resolution of 600 dpi. A multi-stage developing machine having three developing rolls was used, the diameter of each of the developing rolls was 50 mm, and the developing time was set to nearly 90 milliseconds. A two-component developing agent was used for the developing agent, and a styrene-acrylic toner having an average grain size of 11 μm was used for the toner 12. The developing bias voltage was set to 400 V/350 V/300 V in the rotating direction of the photosensitive drum 1 from the upstream side to the downstream side.

The toner image produced by the developing machine 3 was transferred to the paper 11 by the transferring unit 4. The transferring voltage was set to nearly −6.0 kV. Then, the remaining toner not transferred was discharged by the AC discharger 5 having an alternating current frequency of 500 Hz and an applied voltage of 5 kV, and the electrostatic latent image on the photosensitive drum 1 was discharged by the erase lamp 6 emitting red light having a wavelength of nearly 660 nm and a light quantity of 300 μW/cm$^2$ produced by a 15 W white fluorescent lamp through a red filter. Then, the surface of the photosensitive drum 1 was cleaned by the cleaning unit 7 in which cleaning was performed using a fur-brush in this embodiment, and the photosensitive drum 1 was ready for the next image forming operation.

The drum voltages in the above image forming condition were a non-exposed position voltage $V_O$/exposed position voltage $V_R$=800 V/90 V at the position of the sensor 13, 630 V/105 V at the position of the sensor 14 and 500 V/100 V at the position of the sensor 15. At the time 300 milliseconds after charging, the voltage holding rate was 70% and the remaining voltage was 85 V.

Under the above condition, a printing test of about 5000 pages was conducted. As the test result, by the print sample, a high precision image quality having a solidly shaded density of 1.45 (D), a fog level of 0.4%, an MF value of 68% and a resolution equivalent to 480 dpi was obtained. There, the fog level N can be calculated by the equation $N=\gamma_{max}-\gamma_A$, where $\gamma_{max}$ is a reflection coefficient of paper (maximum reflection coefficient) and $\gamma_A$ is an average reflection coefficient in a measuring region A. These reflection coefficients were measured using a Hunter Densitometer. Further, this quality was maintained for a long period, and a practical image could be obtained in a printing test of 3 million pages.

A seventh embodiment will be described below.

In this embodiment, a red LED having a wavelength of 680 nm was used as the writing light source and the amount of exposing light was set to 6 mW on the surface of the photosensitive drum 1. The photosensitive drum 1, which had an outer diameter of 262 mm, a length of 430 mm, a film thickness of 40 μm and a surface roughness of 0.75 μm, employed an $As_2Se_3$ photosensitive material with iodine added in an amount of 300 ppm in order to improve the light responsive characteristic. The rotating speed of the photosensitive drum 1 was 60 rpm and the process time between the charger 2 and the developing machine 3 was nearly 70 milliseconds. The width of the charger 2 was 110 mm, and the charging time of the photosensitive body was set to nearly 133 milliseconds. The spot diameter of the LED exposing light was nearly 40 μm and the resolution was equivalent to 600 dpi.

The same type of developing machine 3 as used in the sixth embodiment was used, and the developing time was set to nearly 95 milliseconds. A two-component developing agent was used for the developing agent, and a styrene-acrylic toner having an average −train size of 7 μm was used for the toner 12. The developing bias voltage was set to 400 V/350 V/300 V in the rotating direction of the photosensitive drum 1 from the upstream side to the downstream side. An LED having a wavelength of 660 nm and a light quantity of 400 μW/cm$^2$ was employed as the erase lamp 6.

Under the image forming condition where the other conditions were set to be the same as in the sixth embodiment, a printing test of about 5000 pages was conducted. The drum voltages in the above image forming condition were a non-exposed position voltage $V_O$/exposed position voltage $V_R$=800 V/80 V at the position of the sensor 13, 630 V/100 V at the position of the sensor 14 and 510 V/100 V at the position of the sensor 15. At the time 300 milliseconds after charging, the voltage holding rate was 70% and the remaining voltage was 75 V. By the print sample, a high precision image quality having a solidly shaded density of 1.45 (D), a fog level of 0.45%, an MF value of 60% and a resolution equivalent to 600 dpi was obtained. Further, this quality was maintained for a long period, and a practical image could be obtained in a printing test of 3 million pages.

An eighth embodiment will be described below.

In this embodiment, a He-Ne laser having a wavelength of 635 nm was used as the writing light source and the amount of exposing light was set to 6 mW on the surface of the photosensitive drum 1. The photosensitive drum 1, which had an outer diameter of 262 mm, a length of 430 mm, a film thickness of 40 μm and a surface roughness of 1.5 μm, employed an $As_2Se_3$ photosensitive material with iodine added in an amount of 10 ppm in order to improve the light responsive characteristic. The rotating speed of the photosensitive drum 1 was 72 rpm and the process time between the charger 2 and the developing machine 3 was nearly 125 milliseconds.

The image forming in accordance with the present invention was executed as follows. Initially, the photosensitive drum 1 was charged to approximately +800 V in surface voltage by applying a voltage of approximately +8.5 kV to the charger 2. The diameter of the corona wires of the charger was 70 μm. The distance between the wires was about 10 mm and the distance between the wire and the drum was also about 10 mm. The width of the charger 2 in the direction of the drum periphery was set to 110 mm. By doing so, the charging time of the photosensitive body was set to approximately 111 milliseconds. Next, image exposure was performed using the scanner unit 10 to form a latent image on the photosensitive drum 1. The spot diameter for the laser exposure in this embodiment was nearly 35 μm which was equivalent to a resolution of 800 dpi.

A multi-stage developing machine having three developing rolls was used, the diameter of each of the developing rolls was 50 mm, and the developing time was set to nearly 80 milliseconds. A two-component developing agent was used for the developing agent, and a styrene-acrylic toner having an average grain size of 11 μm was used for the toner 12. The developing bias voltage was set to 350 V/300 V/250 V in the rotating direction of the photosensitive drum from the upstream side to the downstream side.

The toner image produced by the developing machine 3 was transferred to the paper 11 by the transferring unit 4. The transferring voltage was set to nearly −6.0 kV. Then, the remaining toner not transferred was discharged by the AC discharger 5 having an alternating current frequency of 5 kHz and an applied voltage of 5 kV, and the electrostatic latent image on the photosensitive drum 1 was discharged by the erase lamp 6 emitting red light having a wavelength of nearly 660 nm and a light quantity of 250 μW/cm$^2$ produced by a 15 W white fluorescent lamp through a red filter.

The drum voltages in the above image forming condition were a non-exposed position voltage $V_O$/exposed position voltage $V_R$=800 V/85 V at the position of the sensor 13, 680 V/105 V at the position of the sensor 14 and 550 V/100 V at the position of the sensor 15. A printing test of about 5000 pages was conducted. By the print sample, a high precision image quality having a solidly shaded density of 1.35 (D), a fog level of 0.4% and an MF value of 55% was obtained. Further, this quality was maintained for a long period, and a practical image could be obtained in a printing test of 3 million pages.

A ninth embodiment will be described below.

In this embodiment, an Ar laser having a wavelength of 488 nm was used as the writing light source and the amount of exposing light was set to 8 mW on the surface of the photosensitive drum 1. The photosensitive drum 1, which had an outer diameter of 262 mm, a length of 430 mm, a film thickness of 50 μm and a surface roughness of 0.75 μm, employed an $As_2Se_3$ photosensitive material with iodine added in an amount of 3 ppm in order to improve the light responsive characteristic. The rotating speed of the photosensitive drum 1 was 80 rpm and the process time between the charger 2 and the developing machine 3 was nearly 80 milliseconds. The width of the charger 2 was 110 mm. The spot diameter of the Ar (argon) exposing light was nearly 40 μm and the resolution was equivalent to 600 dpi.

A multi-stage developing machine having four developing rolls was used, the diameter of each of the developing rolls was 50 mm, and the developing time was set to nearly 90 milliseconds. A two-component developing agent was used for the developing agent, and a styrene-acrylic toner having an average grain size of 7 μm was used for the toner 12. The developing bias voltage was set to 400 V/350 V/300 V/250 V in the rotating direction of the photosensitive drum 1 from the upstream side to the downstream side. The erase lamp 6 emitted light having a wavelength of nearly 450 nm and a light quantity of 250 μW/cm$^2$ produced by a 15 W white fluorescent lamp through a blue filter (BPB45).

Under the image forming condition where the other conditions were set to be the same as in the third embodiment, a printing test of about 5000 pages was conducted. The drum voltages in the above image forming condition were a non-exposed position voltage $V_O$/exposed position voltage $V_R$=800 V/75 V at the position of the sensor 13, 700 V/85 V at the position of the sensor 14 and 610 V/85 V at the position of the sensor 15. By the print sample, a high precision image quality having a solidly shaded density of 1.50 (D), a fog level of 0.3% and an MF value of 70% was obtained. Further, this quality was maintained for a long period, and a practical image could be obtained in a printing test of 3 million pages.

A tenth embodiment will be described below.

In this embodiment, four semiconductor lasers arranged in an array having a wavelength of 635 nm were used as the writing light source and the amount of exposing light was set to 8 mW on the surface of the photosensitive drum 1. The photosensitive drum 1, which had an outer diameter of 262 mm, a length of 430 mm, a film thickness of 50 μm and a surface roughness of 0.375 μm, employed an $As_2Se_3$ photosensitive material with iodine added in an amount of 50 ppm in order to improve the light responsive characteristic. The rotating speed of the photosensitive drum 1 was 80 rpm and the process time between the charger 2 and the developing machine 3 was nearly 200 milliseconds. The width of the charger 2 was 80 mm, and the charging time of the photosensitive body was set to nearly 73 milliseconds. The spot diameter of the LED exposing light was nearly 40 μm and the resolution was equivalent to 600 dpi.

A multi-stage developing machine having four developing rolls was used, the diameter of each of the developing rolls was 50 mm, and the developing time was set to nearly 90 milliseconds. A two-component developing agent was used for the developing agent, and a styrene-acrylic toner having an average grain size of 7 μm was used for the toner 12. The developing bias voltage was set to 400 V/350 V/300 V/250 V in the rotating direction of the photosensitive drum 1 from the upstream side to the downstream side. An LED array emitting light having a wavelength of nearly 600 nm and a light quantity of 350 μW/cm$^2$ was used as the erase lamp 6.

Under the image forming condition where the other conditions were set to be the same as in the fourth embodiment, a printing test of about 5000 pages was conducted. The drum voltages in the above image forming condition were a non-exposed position voltage $V_O$/exposed position voltage $V_R$=800 V/85 V at the position of the sensor 13, 660 V/100 V at the position of the sensor 14 and 500 V/100 V at the position of the sensor 15. By the print sample, a high precision image quality having a solidly shaded density of 1.45 (D), a fog level of 0.5% and an MF value of 65% was obtained. Further, this quality was maintained for a long period, and a practical image could be obtained in a printing test of 3 million pages.

As described above, the image forming apparatus in accordance with the present invention can stably perform high quality printing with a high resolution above nearly 400 dpi, even in a high speed print process as fast as approximately 100 pages per minute.

What is claimed is:

1. An image forming apparatus forming an electrostatic latent image on a charged surface of a photosensitive body by exposing the charged surface of the photosensitive body to a writing light, developing said latent image using a toner to form a toner image, transferring said toner image to an image holding body, and erasing the charge on the surface of said photosensitive body after completion of transferring of the toner image using a charge erasing light, wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and a film thickness of said photosensitive body is limited within a range of 40 μm to 80 μm.

2. An image forming apparatus according to claim 1 wherein said wavelength $\lambda_0$ of the writing light is limited to a wavelength within the range of 600 nm to 720 nm.

3. An image forming apparatus according to claim 1, wherein said wavelength $\lambda_1$ of the charge erasing light is limited to a wavelength within the range of 450 nm to 660 nm.

4. An image forming apparatus according to any one of claim 1 to claim 3, wherein said wavelength $\lambda_0$ of the writing light and said wavelength $\lambda_1$ of the charge erasing light satisfy the relation $$\lambda_0-100\text{ nm}\leqq\lambda_1\leqq680\text{ nm}.$$

5. An image forming apparatus according to claim 1, wherein halogen is added to said photosensitive body in an amount of 1 ppm to 500 ppm.

6. An image forming apparatus according to claim 1, wherein the surface roughness of said photosensitive body is limited to a center line average roughness (Ra) within the range of 0.125 μm to 1.5 μm.

7. An image forming apparatus according to claim 1, wherein a charging time of said photosensitive body is limited to a time period within the range of 30 milliseconds to 300 milliseconds.

8. An image forming apparatus according to claim 1, wherein a developing time is limited to a time period within the range of 50 milliseconds to 200 milliseconds.

9. An image forming apparatus according to claim 1, wherein at least two developing rolls are used in said developing, and a developing bias voltage applied to each of said developing rolls decreases in the rotating direction of the photosensitive body from the upstream side to the downstream side.

10. An image forming apparatus according to claim 1, wherein a voltage difference on the surface of the photosensitive body between a toner attached portion and a toner non-attached portion just before transferring a toner image to said image holding body is above 300 V.

11. An image forming apparatus according to claim 1, wherein an AC corona charger is used for charge erasing, and the frequency of current applied to said AC corona charger for charge erasing is limited to a frequency within the range of 500 Hz to 7000 Hz.

12. A method of image forming using an image forming apparatus comprising the steps of:

forming an electrostatic latent image on a charged surface of a photosensitive body by exposing the charged surface of the photosensitive body to a writing light;

developing said latent image using a toner to form a toner image;

transferring said toner image to an image holding body; and erasing the charge on the surface of said photosensitive body after completion of transferring of the toner image using a charge erasing light; wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and a film thickness of said photosensitive body is limited within a range of 40 μm to 80 μm.

13. A method according to claim 12, wherein said wavelength $\lambda_0$ of the writing light is limited to a wavelength within the range of 600 nm to 720 nm.

14. A method according to claim 12, wherein said wavelength $\lambda_1$ of the charge erasing light is limited to a wavelength within the range of 450 nm to 660 nm.

15. A method according to claim 12, wherein said wavelength $\lambda_0$ of the writing light and said wavelength $\lambda_1$ of the charge erasing light satisfy the relation $$\lambda_0-100\text{ nm}\leqq\lambda_1\leqq680\text{ nm}.$$

16. A method according to claim 12, wherein a charging time of said photosensitive body is limited to a time period within the range of 30 milliseconds to 300 milliseconds.

17. A method according to claim 12, wherein a developing time is limited to a time period within the range of 50 milliseconds to 200 milliseconds.

18. An image forming apparatus forming an electrostatic latent image on a charged surface of a photosensitive body by exposing the charged surface of said photosensitive body to a writing light, developing said latent image using a toner to form a toner image, transferring said toner image to an image holding body, and erasing the charge on the surface of said photosensitive body after completion of transferring of the toner image using a charge erasing light, wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and a surface roughness of said photosensitive body is limited to a center line average roughness (Ra) within a range of 0.125 μm to 1.5 μm.

19. An image forming apparatus forming an electrostatic latent image on a charged surface of a photosensitive body by exposing the charged surface of said photosensitive body to a writing light, developing said latent image using a toner to form a toner image, transferring said toner image to an image holding body, and erasing the charge on the surface of said photosensitive body after completion of transferring of the toner image using a charge erasing light, wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and at least two developing rolls are used in said developing, and a developing bias voltage applied to each of said developing rolls decreases in a rotating direction of said photosensitive body from an upstream side to a downstream side.

20. An image forming apparatus forming an electrostatic latent image on a charged surface of a photosensitive body by exposing the charged surface of said photosensitive body to a writing light, developing said latent image using a toner to form a toner image, transferring said toner image to an image holding body, and erasing the charge on the surface of said photosensitive body after completion of transferring of the toner image using a charge erasing light, wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and a voltage difference on the surface of said photosensitive body between a toner attached portion and a toner non-attached portion just before transferring a toner image to said image holding body is above 300 V.

21. An image forming apparatus forming an electrostatic latent image on a charged surface of a photosensitive body by exposing the charged surface of said photosensitive body to a writing light, developing said latent image using a toner to form a toner image, transferring said toner image to an image holding body, and erasing the charge on the surface of said photosensitive body after completion of transferring of the toner image using a charge erasing light, wherein said photosensitive body formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and an AC corona charger is used for charge erasing, and a frequency of current applied to said AC corona charger for charge erasing is limited to a frequency within a range of 500 Hz to 7000 Hz.

22. A method of image forming using an image forming apparatus comprising the steps of:

forming an electrostatic latent image on a charged surface of a photosensitive body by exposing the charged surface of said photosensitive body to a writing light;

developing said latent image using a toner to form a toner image;

transferring said toner image to an image holding body; and erasing the charge on the surface of said photosensitive body after completion of transferring of the toner image using a charge erasing light; wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and a surface roughness of said photosensitive body is limited to a center line average roughness (Ra) within a range of 0.125 μm to 1.5 μm.

23. A method of image forming using an image forming apparatus comprising the steps of:

forming an electrostatic latent image on a charged surface of a photosensitive body by exposing the charged surface of the photosensitive body to a writing light;

developing said latent image using a toner to form a toner image;

transferring said toner image to an image holding body; and erasing the charge on the surface of said photosensitive body after completion of transferring of the toner image using a charge erasing light; wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and at least two developing rolls are used in said developing, and a developing bias voltage applied to each of said developing rolls decreases in a rotating direction of said photosensitive body from an upstream side to a downstream side.

24. A method of image forming using an image forming apparatus comprising the steps of:

forming an electrostatic latent image on a charged surface of a photosensitive body by exposing the charged surface of said photosensitive body to a writing light;

developing said latent image using a toner to form a toner image;

transferring said toner image to an image holding body; and erasing the charge on the surface of said photosensitive body after completion of transferring of the toner image using a charge erasing light; wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and a voltage difference on the surface of said photosensitive body between a toner attached portion and a toner non-attached portion just before transferring a toner image to said image holding body is above 300 V.

25. A method of image forming using an image forming apparatus comprising the steps of:

forming an electrostatic latent image on a charged surface of a photosensitive body by exposing the charged surface of said photosensitive body to a writing light;

developing said latent image using a toner to form a toner image;

transferring said toner image to an image holding body; and erasing the charge on the surface of said photosensitive body after completion of transferring of the toner image using a charge erasing light; wherein said photosensitive body is formed of a base material selected from the group consisting of $As_2Se_3$ and a-Si;

the wavelength $\lambda_0$ of the writing light used for said exposure is limited to a wavelength not larger than 780 nm;

the wavelength $\lambda_1$ of the charge erasing light used for said charge erasing is limited to a wavelength smaller than 680 nm;

the time $T_1$ from completion of said exposure to initiation of said development is limited within the range of 70 milliseconds to 300 milliseconds; and an AC corona charger is used for charge erasing, and a frequency of current applied to said AC corona charger for charge erasing is limited to a frequency within a range of 500 Hz to 7000 Hz.

* * * * *